United States Patent [19]

Blakeway

[11] 4,306,394

[45] Dec. 22, 1981

[54] SWIMMING POOL

[75] Inventor: Stanley R. Blakeway, Stafford Heights, Australia

[73] Assignee: Blakeway Marviroll Pools Pty. Ltd., Strathpine, Australia

[21] Appl. No.: 16,039

[22] Filed: Feb. 28, 1979

[30] Foreign Application Priority Data

Mar. 8, 1978 [AU] Australia ..... PD3637

[51] Int. Cl.[3] ..... E04H 3/16; E04H 3/18

[52] U.S. Cl. ..... 52/169.7; 52/285; 52/461; 4/513

[58] Field of Search ..... 4/172.19, 506, 513; 52/169.7, 288, 397, 285, 282, 461, 395

[56] References Cited

U.S. PATENT DOCUMENTS

| | | | |
|---|---|---|---|
| 2,822,588 | 2/1958 | West | 52/397 |
| 3,323,818 | 6/1967 | Barker | 52/285 |
| 3,739,539 | 6/1973 | Posnick | 4/172.19 |
| 3,930,346 | 1/1976 | Blakeway | 52/169.7 |
| 3,938,199 | 2/1976 | Laven | 4/172.19 |
| 3,952,338 | 4/1976 | Troxclair | 4/172.19 |

FOREIGN PATENT DOCUMENTS

| | | | |
|---|---|---|---|
| 4144 | 9/1979 | European Pat. Off. | 52/169.7 |

*Primary Examiner*—John E. Murtagh

*Attorney, Agent, or Firm*—Schwartz, Jeffery, Schwaab, Mack, Blumenthal & Koch

[57] ABSTRACT

A swimming pool has a pair of end members made of sheet material each having its side and bottom edge portions secured and sealed in a longitudinal groove in a flexible strip of extruded material, the strip also having a pair of longitudinal spaced parallel flanges perpendicular to the groove; and a side and bottom piece of flexible sheet material, each lateral edge of which is engaged in the channel defined by the parallel flanges of the flexible strip secured to the sides and bottom of an end member and sealed by a sealing strip between the lateral edge and the outer of the two flanges.

9 Claims, 7 Drawing Figures

SWIMMING POOL

BACKGROUND OF THE INVENTION

This invention relates to an improved swimming pool.

The specification of my U.S. Pat. No. 3,930,346 describes and illustrates an in-ground swimming pool having rigid planar ends, each with a pair of parallel inwardly extending curved flanges secured to its inside face, the sides and bottom of the pool being a sheet of flexible sheet material engaged at each end between the flanges of an end member of the pool and sealed by a resilient gasket between the sheet and the inner one of the two flanges.

The object of the present invention is to provide an in-ground swimming pool of the general type set out, and which is particularly simple and economical to manufacture and to install, and which may, with minor modifications, be made in any of a wide variety of shapes.

BRIEF SUMMARY OF THE INVENTION

The invention resides broadly in a swimming pool including a pair of end members of sheet material; a junction member secured on the side and bottom edges of each end member, and having a longitudinal groove engaging these edges, the edge portions which are secured by wedging means; the junction member also having a pair of flanges substantially perpendicular to its groove; a side and bottom member of sheet material, its end edges engaged between the flanges of the junction members of both end members; and a resilient sealing gasket compressed between the engaged ends of the side and bottom member and the inside flanges of the junction members.

DESCRIPTION OF THE PREFERRED EMBODIMENTS

Figure 1:
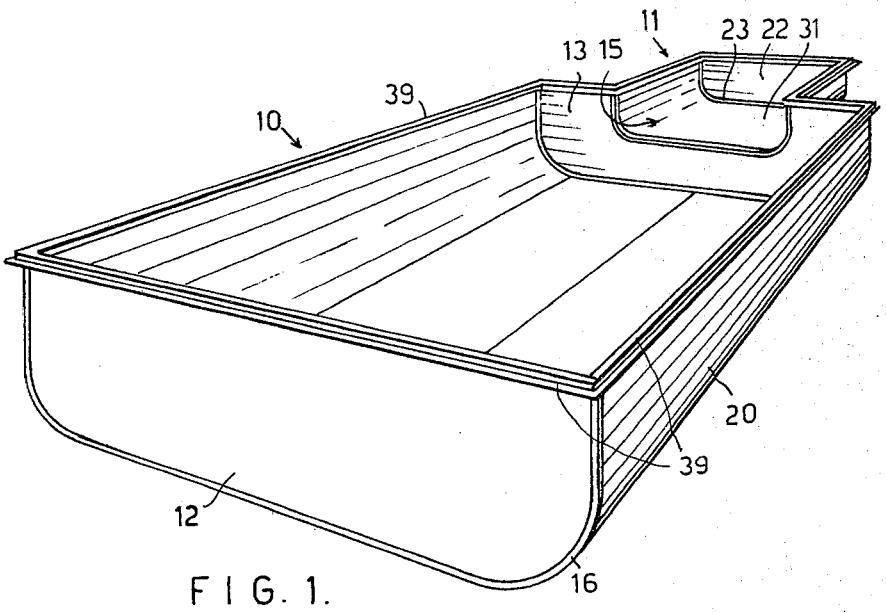
FIGS. 1, 2, 3 and 4 are perspective views of swimming pools according to different embodiments of the invention.
Figures 5, 6, 7:
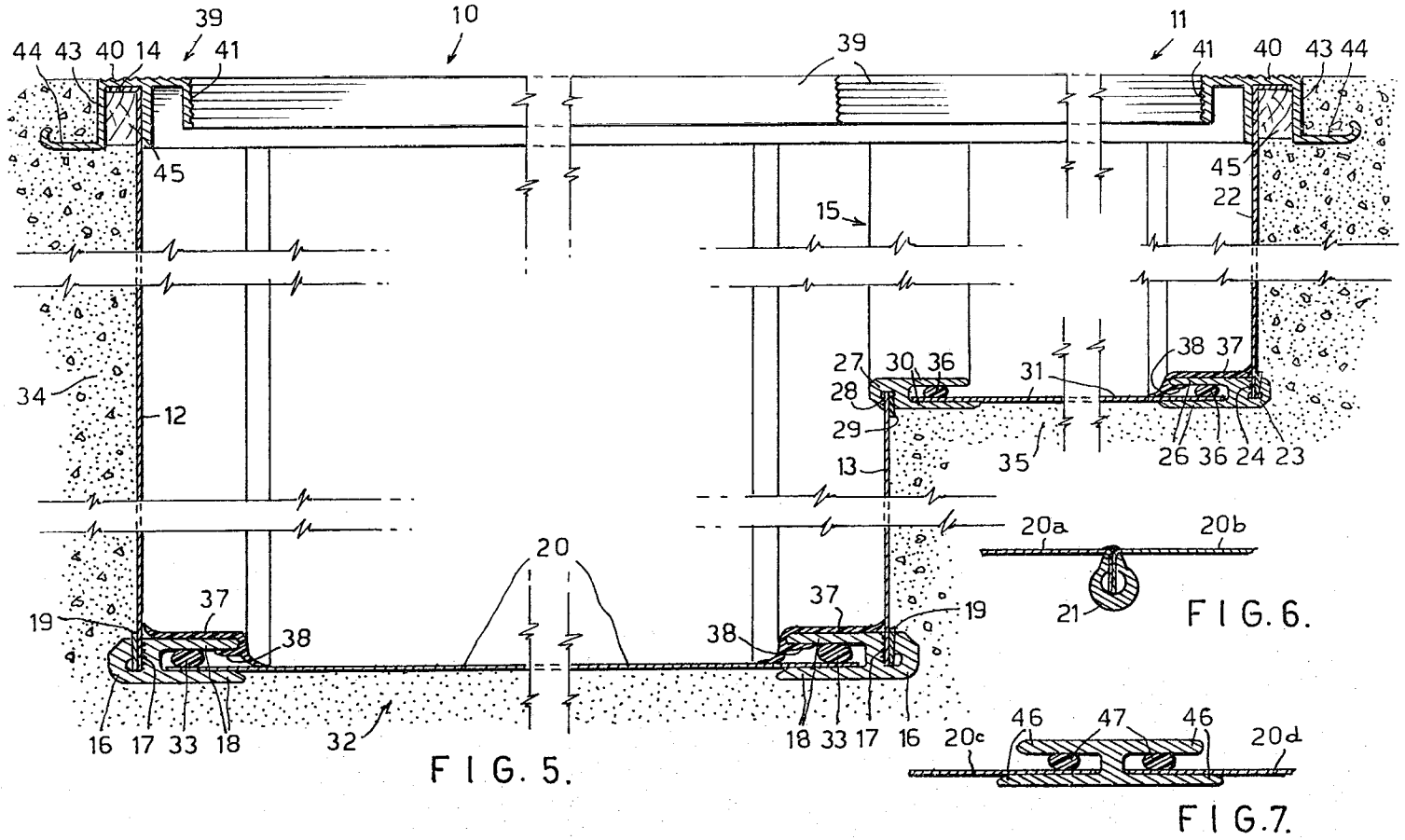
FIG. 5 is a partly broken-away section of the pool shown in FIG. 1.
FIG. 6 is a detail drawing showing the connection of two adjacent sheet metal sections of a pool.
FIG. 7 is a detail drawing showing the end-to-end connection of two sheet metal sections.

In FIGS. 1 and 5, a swimming pool of in-ground type comprises a main pool 10 and a communicating shallow wading pool 11. The main pool 10 has two ends 12 and 13 of sheet steel with vinyl bonded to both sides, and of similar width, depth and radiused lower corners, their upper edge portions being bent over as stiffening flanges 14. The end 13 has an opening 15 cut from its top edge to communicate with the wading pool 11.

A junction member 16 of extruded aluminium, bent to appropriate shape, is secured to the side and bottom edges of each of the ends 12 and 13, having a longitudinal groove 17 to receive these edges with some clearance, and also has two parallel flanges 18 extending perpendicularly from the end member. A wedging strip 19 driven into the groove 17 to force the inside face of the end against one side of the groove, which is formed with parallel longitudinal serrations to ensure a secure and watertight connection.

The side and bottom member 20 of the pool is a rectangle of sheet material such as sheet steel with vinyl bonded to both sides, and may be rolled up for transport. Its edges are bent outwardly to form stiffening flanges similar to the flanges 14. The side and bottom member 20 may be made of several sections joined as shown in FIG. 6 by bending the edges of the sections 20*a* and 20*b* outwardly to form flanges which are firmly interconnected and sealed by a joining strip 21, which has a slot into which these flanges are forced. This joint is filled by a sealing compound at its ends.

The wading pool 11 has a single end member 22 of similar shape to the opening 15, and of similar material to the main pool ends. A junction strip 23 generally similar to the junction strips 16, with a longitudinal groove 24 and parallel longitudinal flanges 26, is secured to the end member 22 as before described.

A further junction strip 27 engaging the sides and bottom of the opening 15 in the main pool end member 13 is similar to the junction strip 23 except that its groove 28 engaging these edges is oppositely directed. It is secured, as before described, by a wedging strip 29, its parallel flanges 30 extending perpendicularly outwards from the main pool end member 13.

The wading pool side and bottom member 31 is smaller than, but otherwise similar to, the side and bottom member 20 of the main pool 10.

The excavation for the main pool 10 and wading pool 11 being made, and a bed of sand 32 being introduced therein, the main pool end members 12 and 13 are positioned, and the rolled-up side and bottom member 20 is unrolled, its end edges being engaged between the flanges 18, the outside flanges being notched to receive the ends of the joining strips 21.

The end edges of the side and bottom member 20 are sealed by round-section rubber sealing strips 33 driven in between them and the inside flanges 18.

Concrete 34 is poured about the lower part of the main pool 10, which is part filled with water. A sand bed 35 is placed for the wading pool 11, the side and bottom member 31 of which has its end edges engaged between the parallel flanges 30 of the junction strip 27 about the opening 15, and the flanges 26 of the junction strip 23 about the end member 22, sealing strips 36 being applied as before described.

Each of the junction strips 16 and 23 is covered by a flexible extruded cover strip 37 of a plastics material, with a flange 38 gripping the inside flange of the junction strip.

A coping 39 applied to the top edges of the pool comprises extruded metal sections with a top 40 and three vertical flanges, being comprising an inside anti-splash flange 41, an intermediate flange 42 and an outside flange 43 with an outwardly extending key flange 44. The top edges of the pool are fitted between the flanges 42 and 43, and are held by wooden blocks 45 in an adjustable manner, so that if the upper edges of the pool should not be exactly level, the coping 39 may be raised where necessary.

Further concrete 34 is poured about the main pool and the wading pool 11, to cover the key flange 44.

The wading pool 11 may be omitted, the pool then having two oppositely arranged similar end members 12.

If, in some cases, the side and bottom member 20 is too long for convenient transport, two side and bottom sections may be connected end to end by the extruded double connector strip shown in FIG. 7, having two oppositely directed pairs of flanges 46 to receive the ends of succeeding sheet metal sections 20*c* and 20*d* which are sealed by resilient sealing strips 47.

Figure 2:
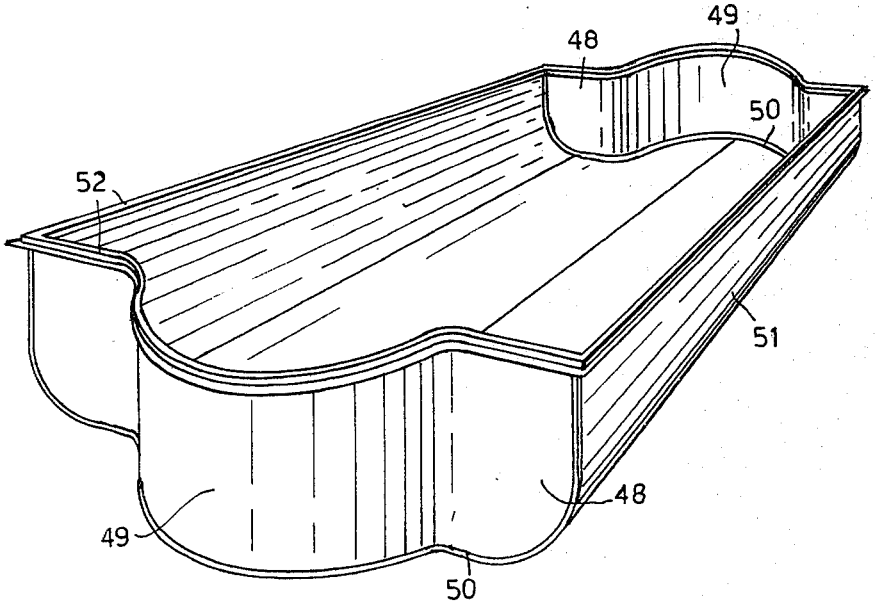

The pool shown in FIG. 2 has two similar but oppositely arranged end members 48 which have central outwardly-bowed portions 49, the junction strip 50 applied to each end member therefore being bent to the bowed form in the direction of its width, as well as being bent in the direction of its depth to follow the radiused lower corner portions of the end member. The side and bottom member 51 is parallel-sided, but its ends are shaped to extend into the bowed parts 49 of the pool end members. The pool coping 52 is also shaped, at both ends of the pool, to follow the contours of the outwardly-bowed parts 49.

Figure 3:
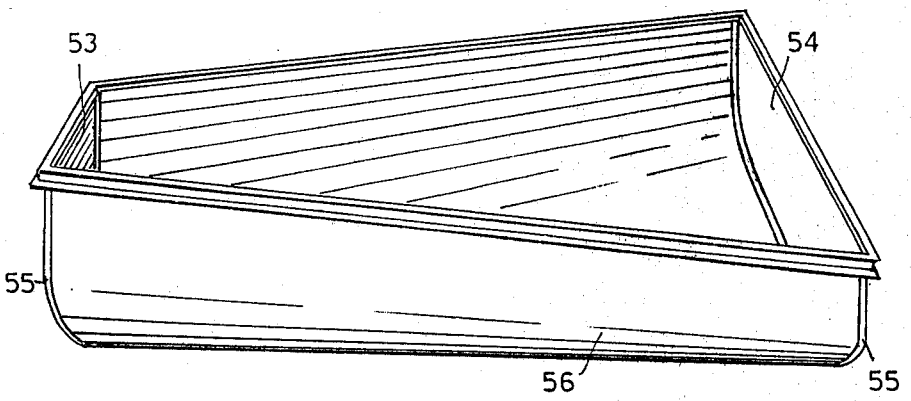

The swimming pool illustrated in FIG. 3 has two end members 53 and 54 of flat vinyl coated sheet steel, the end member 53 being of lesser width and of greater depth than the end member 54. Each has a junction strip 55 as before described secured about its sides and bottom, and its side and bottom member 56 is made with parallel sides but with ends shaped to engage in the junction strips 55 of both ends to produce a pool which at one end is deeper, though narrower, than at the other end, the spacing of the flanges of the junction strips allowing the insertion of the oblique ends of the side and bottom member, which are sealed as before described.

Figure 4:
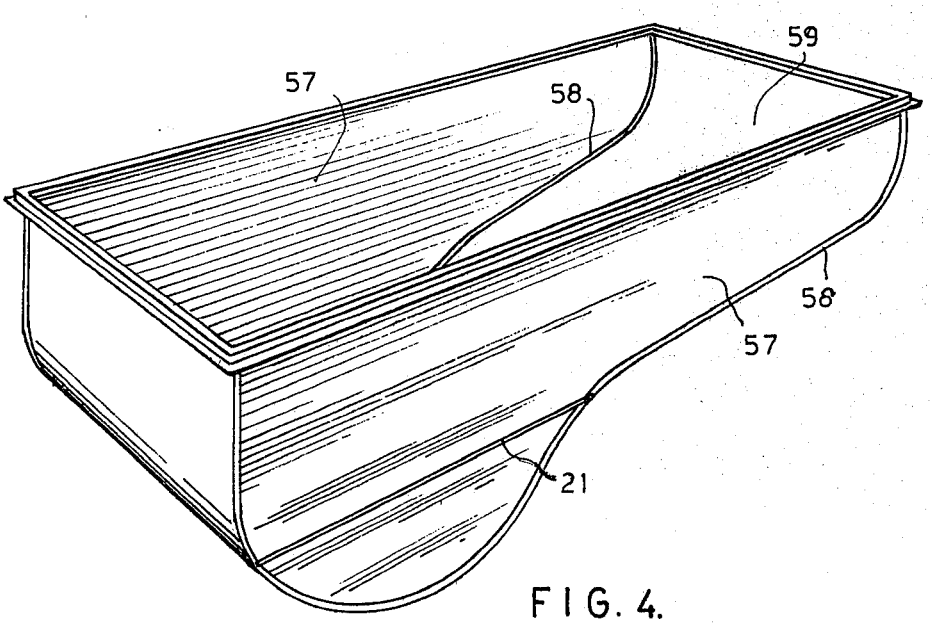

The pool illustrated in FIG. 4 has two similar end members 57 made of vinyl coated sheet steel with a junction strip 58 secured abouts its side and bottom edge portions as before described, and a side and bottom member 59 which is a rectangular piece of similar material. The two end members 57, instead of being made with flat or nearly flat bottom edges, are deep at one side and of much lesser depth at the other, and each comprise two sheet metal parts connected by the connector strip 21 shown in FIG. 6. In this embodiment, the side and bottom member 59 is of considerably greater width than length, and the end members 57 are the equivalent of sides of the pool, having one deep end suitable for diving.

Swimming pools according to the invention will be found to be very effective in achieving the objects for which they have been devised, being simple and economical to manufacture and to install, and capable of being produced in a wide variety of shapes and sizes.

The sheet metal piece forming the sides and bottom of such a pool is not fixedly secured to the pool ends, but is permitted some movement, as its ends can move slidably between the parallel flanges of the junction members, the resilient round-section sealing strips being rolled between the sheet metal piece and the junction member flanges. Consequently, minor earth movements which could cause cracking of a concrete pool will not be likely to damage pools according to the invention. It is known for hydrostatic pressure in the soil to lift and severely damage a concrete pool, but a pool according to the invention will, under such conditions, have its bottom so distorted upwardly that at least one sealing strip is likely to be rolled clear of a junction member so that external water is admitted to the pool, equalising the pressure, and subsequently the pool can be easily re-sealed.

We claim:

1. A swimming pool comprising:

(a) side and bottom wall means formed of a flexible sheet metal which can be rolled to facilitate shipment and unrolled to form the side and bottom walls of a pool of a desired size and configuration;

(b) end walls also formed of flexible sheet metal adapted to be sealably interconnected to said side and bottom wall means;

(c) a flexible metal junction strip for interconnecting the end walls and said side and bottom walls means in a sealed manner, said strip having a longitudinal groove for receiving the side and bottom edges of said end walls and further comprising spaced parallel flanges extending inwardly of the pool, said flanges being spaced so as to freely receive the adjacent edges of said side and bottom wall means, (d) an elastomeric sealing strip driven or wedged into the space between said flanges unoccupied by said adjacent edges of said side and bottom wall means, whereby a water tight connection is maintained while simultaneously permitting a degree of movement of said side and bottom wall means relative to said junction strip and said end walls to accommodate earth movement, and (e) a flexible plastic cover strip secured to one of said flanges of each of said junction strips, with said cover strip having tapered, flexible ends extending into engagement with said end walls and said side and bottom walls means so as to seal said junction strip.

2. A swimming pool according to claim 1 wherein said side and bottom wall means are formed in a plurality of sections, with the adjoining edges of each section being sealably connected.

3. A swimming pool according to claim 1 wherein the side of said groove nearer to said flanges is formed with longitudinal serrations, and the side and bottom edges of the end walls are secured in the groove by a flexible wedging strip driven between the other side of the groove and the outside surface of said side and bottom edges.

4. A swimming pool according to claim 1 wherein one of said end walls has formed from its top an opening having substantially the cross-sectional shape of the sides and bottom of a wading pool, a wading pool end wall of substantially similar shape to said opening, the side and top edges of said one end wall being secured in a longitudinal groove of a flexible inner wading pool junction strip having a pair of spaced parallel longitudinal flanges extending inwardly perpendicular to said groove, the side and bottom edges of said wading pool end wall being secured in a longitudinal groove of a flexible outer wading pool junction strip having a pair of spaced parallel longitudinal flanges extending inwardly toward said inner wading pool strip, and wading pool side and bottom wall means of resilient flexible material, the lateral edge portions of which are engaged and sealed between the flanges of the inner and outer wading pool junction strips.

5. A swimming pool according to claim 4 further including elastomeric sealing strips driven or wedged into the space between said flanges of said inner and outer wall junction strips whereby a water tight connection is maintained.

6. A swimming pool according to claim 1 wherein at least one of the end walls and the flexible metal junction strip secured to the side and bottom edges thereof are formed with a central outwardly bowed portion.

7. A swimming pool according to claim 1 wherein one end wall is of greater depth than the other.

8. A swimming pool according to claim 1 wherein both end walls are of greater depth at one side than at the other, and the width of the end wall is greater than the distance between them.

9. A swimming pool according to claim 1 wherein said flexible plastic cover strip comprises a flange spaced from the tapered, flexible end thereof which engages said end wall, said flange and said tapered flexible end tightly gripping the uppermost one of said spaced parallel flanges of said flexible metal junction strip thereby to retain said cover strip in sealed position.

* * * * *